US006739380B2

(12) United States Patent
Schlienger et al.

(10) Patent No.: US 6,739,380 B2
(45) Date of Patent: May 25, 2004

(54) METHOD AND APPARATUS FOR REMOVING CERAMIC MATERIAL FROM CAST COMPONENTS

(75) Inventors: Max Eric Schlienger, Napa, CA (US); Michael D. Baldwin, Napa, CA (US); Ariel Eugenio, Benicia, CA (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 10/412,567

(22) Filed: Apr. 10, 2003

(65) Prior Publication Data

US 2004/0003909 A1 Jan. 8, 2004

Related U.S. Application Data

(60) Provisional application No. 60/372,314, filed on Apr. 11, 2002.

(51) Int. Cl.[7] ..... B22D 29/00

(52) U.S. Cl. ..... 164/131; 164/132; 164/345; 134/2; 134/3; 134/22.1; 134/11; 134/22.17; 134/166 R; 134/105; 134/113; 134/57 R; 134/44

(58) Field of Search ..... 164/131, 132, 164/345; 134/2, 3, 22.1, 11, 22.17, 166 R, 105, 113, 57 R, 44

(56) References Cited

U.S. PATENT DOCUMENTS

| | | | | |
|---|---|---|---|---|
| 4,141,781 A | | 2/1979 | Greskovich et al. | |
| 4,317,685 A | | 3/1982 | Ahuja et al. | |
| 4,552,198 A | | 11/1985 | Mills et al. | |
| 4,698,130 A | | 10/1987 | Restall et al. | |
| 5,332,023 A | * | 7/1994 | Mills | 164/132 |
| 5,415,193 A | | 5/1995 | Taricco | |
| 5,449,010 A | | 9/1995 | Taricco | |
| 5,498,132 A | | 3/1996 | Carozza et al. | |
| 5,678,583 A | | 10/1997 | Conroy et al. | |
| 5,778,963 A | | 7/1998 | Parille et al. | |
| 5,779,809 A | * | 7/1998 | Sangeeta | 134/2 |
| 5,882,422 A | | 3/1999 | Obayashi et al. | |
| 5,915,452 A | * | 6/1999 | Conroy et al. | 165/345 |
| 6,241,000 B1 | | 6/2001 | Conroy et al. | |
| 6,354,310 B1 | * | 3/2002 | Farr et al. | 134/56 R |
| 6,474,348 B1 | | 11/2002 | Beggs et al. | |
| 2002/0074017 A1 | | 6/2002 | Schilbe et al. | |

* cited by examiner

*Primary Examiner*—Kiley Stone
*Assistant Examiner*—I.-H. Lin
(74) *Attorney, Agent, or Firm*—Woodard, Emhardt, Moriarty, McNett & Henry LLP

(57) ABSTRACT

The removal of ceramic material from the interior of cast metallic components is accomplished in a closed system. A vessel within the system is filled with a chemical leaching fluid that immerses the cast component having the ceramic material and/or ceramic cores therein. The leaching fluid is superheated and boiling is controlled by varying the pressure within the closed system without changing the molecules in the vessel.

29 Claims, 10 Drawing Sheets

METHOD AND APPARATUS FOR REMOVING CERAMIC MATERIAL FROM CAST COMPONENTS

CROSS-REFERENCE TO RELATED APPLICATONS

The present application claims the benefit of U.S. Provisional Patent Application No. 60/372,314 filed on Apr. 11, 2002, which is incorporated herein by reference.

BACKGROUND OF THE INVENTION

The present invention relates generally to the removal of ceramic casting cores from a cast component. More particularly, the present invention relates to a closed leaching system that varies the pressure within the system to change the temperature of the leaching fluid during removal of the ceramic material from the cast component. Although the present invention was developed for manufacturing gas turbine engine components, many additional applications of the present invention are outside of this field.

Typically in the design of gas turbine engine components there is included internal cavities, openings and/or passages for the flow of cooling media. Generally, the internal cavities, openings and/or passages are formed by the placement of a ceramic core into the mold and molten metal is then solidified within the mold and around the core to form the casting. The ceramic core must then be removed from the casting to yield the desired cast component. The scientific community analyzing the removal of ceramic cores from castings appreciates that the process should be benign to the material used to form the casting.

There are prior processes for leaching ceramic material from the interior of cast metallic components. One prior process for leaching ceramic material from cast metallic components is set forth in U.S. Pat. No. 5,332,023 to Mills, which is incorporated herein by reference. Within the '023 patent there is disclosed a leaching system wherein the pressure within an enclosure is varied between atmospheric pressure and no more than 0.45 bar below atmospheric pressure to induce intermittent boiling. The intermittent boiling agitates the leaching fluid and causes a mixing of the leaching material. Included in this disclosed leaching system is that there is a connection to atmospheric pressure that is controlled to increase the pressure within the enclosure on demand and a vacuum pump that is used to lower the pressure within the enclosure on demand. Accordingly, each time the pressure is changed within the enclosure a quantity of the molecules within the enclosure is changed. This change in quantity and/or type of molecules causes a change in the concentration of the leaching material. A limitation associated with the system disclosed in the '023 patent is that the change in concentration of the leaching material affects many parameters including, but not limited to, boiling point, leaching efficiency and the potential for chemical degradation of the cast component Although many of the prior processes for leaching ceramic material from the interior of cast metallic components are steps in the right direction, there still remains a need for additional improvement. The present invention satisfies this need in a novel and non-obvious way.

SUMMARY OF THE INVENTION

One form of the present invention contemplates a method for removing a ceramic material from a cast component. The method, comprising: (a) placing the cast component within a vessel with at least a portion of the ceramic core in contact with a leaching material; (b) heating the leaching material; (c) reducing the pressure within the vessel to superheat the leaching material and nucleate boiling bubbles on at least the cast component; (d) increasing the pressure within the vessel to raise the boiling temperature of the leaching material; and (e) wherein during at least (c) and (d) the vessel is closed to inhibit a change in the concentration of the leaching material by evaporation from the vessel.

Another form of the present invention contemplates a system using leaching material to remove material from an object. The system, comprising: a vessel adapted to contain a quantity of the leaching material, the vessel defines a closed volume including a headspace for gaseous material; a heater operable to heat the leaching material within the vessel; a sensor for sensing a first parameter associated with the leaching material within the vessel; and, a volume variation mechanism defining a portion of the closed volume, the volume variation mechanism operable to change the size of the headspace and pressure therein without changing the number of atoms within the closed volume, the volume variation mechanism being operable upon the first parameter satisfying a predetermined condition.

Another form of the present invention contemplates a system for removing ceramic material from a molded metallic object. The system, comprising: a closed vessel having an interior volume containing a first portion for leaching material and a second portion for gaseous material; a heat supply for heating the leaching material within the vessel; a condenser coupled with the vessel for condensing vapor within the vessel; a sensor for sensing a parameter of the leaching material; means for precisely changing the pressure within the closed vessel without changing the quantity of atoms within the interior volume; and, an electronic controller for operating the means for precisely changing the pressure according to time and feedback from the sensor.

One object of the present invention is to provide a unique method for removing ceramic material from cast components.

Related objects and advantage of the present invention will be apparent from the following description.

DESCRIPTION OF THE PREFERRED EMBODIMENTS

Figure 1:
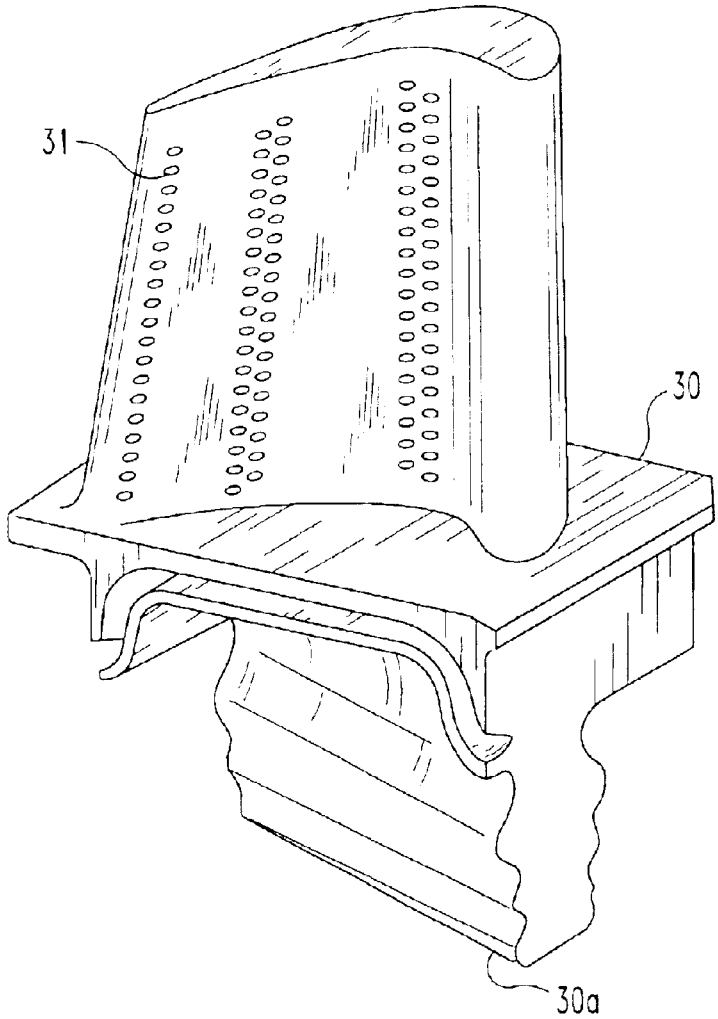
FIG. 1 is a perspective view of one type of cast component.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

With reference to FIG. 1, there is illustrated a non-limiting example of a cast metallic component 30. Cast component 30 is representative of a cooled gas turbine engine blade having an internal cooling system (not illustrated) and a plurality of discharge apertures 31. However, it is understood that the present invention is applicable to the removal of ceramic material and/or ceramic cores from a great variety of types of cast components and is not limited to gas turbine engine components. The types of cast components that can be processed with forms of the present invention include virtually all fields and can be made of a great variety of materials and crystal configurations. The components can be formed of metallic and/or inter-metallic materials and have crystal structures consistent with single crystal, directionally solidified, and/or equiax. Gas turbine engine component designers are particularly interested in nickel and cobalt alloys and superalloys. However, all types of materials including, but not limited to, metallic and inter-metallic materials are contemplated herein. While the present invention will be described with reference to a gas turbine engine blade it should be understood that the process is equally applicable to virtually any type of casting. Further, the present invention also contemplates application to components/objects that are formed by means other than casting.

Techniques to produce a cast component are generally known to those of ordinary skill in the art and therefore no significant description of producing a casting is set forth herein. Pouring molten metal into a casting mold and solidifying within the mold and around at least one casting core into a predetermined configuration generally forms a cast component. The resulting cast component after the ceramic core has been removed may be used in an as cast state, may undergo significant machining, may undergo heat treatment, may have material added, etc Referring to FIGS. 1–3, there is illustrated that the component 30 includes at least one ceramic core to define internal passageways and/or openings in the cast component. The present invention contemplates ceramic material and/or ceramic casting cores of a variety of materials, complexity, size, shape, quantity, porosity and number of pieces. The internal passageways and/or openings define hollow portions in the component that have some communication with the outside of the component. For the sake of simplicity the resulting cooling configuration and ceramic cores are shown simplified; in practice the cooling passage and ceramic casting cores are likely to be of a far more complex configuration. In spite of the great variety of ceramic casting cores that can be utilized during the formation of the cast component they all must be removed after the molten metal is solidified to yield a useable component. There is no intention to limit the present invention to the removal of cores having any size and/or geometric shapes. Thus, the present invention is applicable to the removal of virtually any ceramic core and/or ceramic material that can be exposed to a leaching material. Further, the present invention contemplates utilization to remove other types of materials from components as produced or that have been used and require service/repair and/or refurbishment. A non-limiting example of a component that has been used is a gas turbine engine blade that has been run and requires the removal of oxides from an internal passageway. The present invention will be described in terms of ceramic material and/or ceramic core removal but contemplates the removal of other types of materials.

Figure 2:
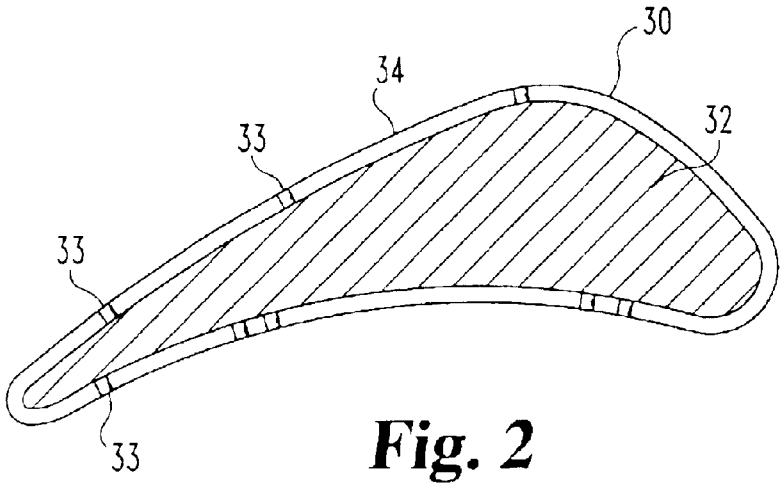
FIG. 2 is an illustrative cross-sectional view of FIG. 1 comprising a ceramic core within the cast component.
Figure 3:
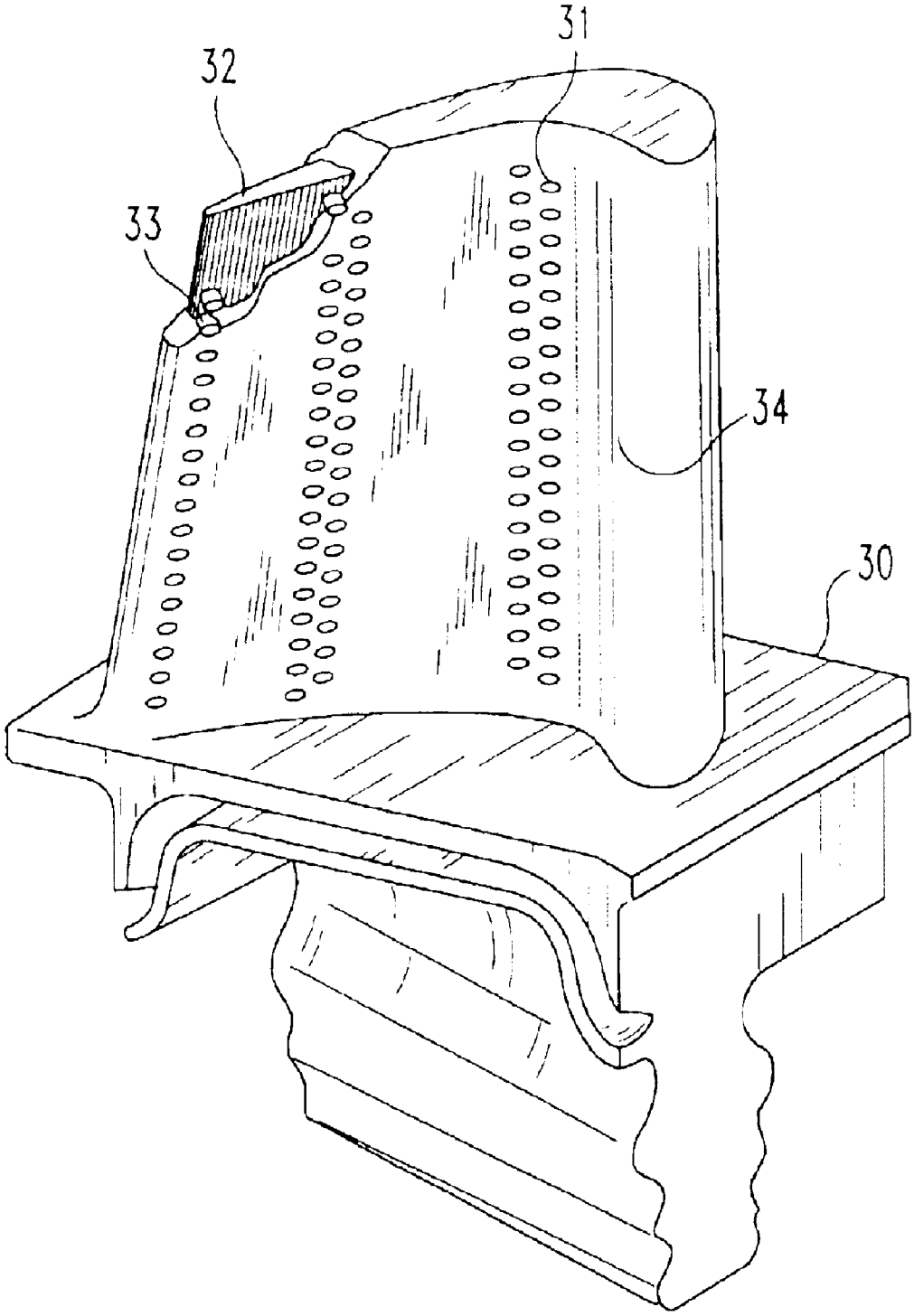
FIG. 3 is an illustrative partially fragmented view of the component of FIG. 1.

With reference to FIG. 2, there is illustrated a ceramic core 32 that defines an internal passageway within the cast component 30. The ceramic core 32 is disposed in communication with the outside 34 of the cast component through at least a plurality of ceramic cores 33 and through an opening in the bottom surface 30*a* of the component 30. While the illustration in FIGS. 1–3 shows the location of specific openings to reach the outside surface of the component, they are purely illustrative and intend to be non-limiting. The present invention contemplates the ability to remove the unwanted material through any opening that allows the leaching material to contact the ceramic material.

The ceramic cores and/or ceramic material utilized to form internal passageways and/or openings in the cast component can be provided in a variety of ways including, but not limited to, integral, individual and/or mechanically coupled. Materials contemplated for ceramic cores include all ceramic materials and mixtures thereof that are removable with a leaching material. Ceramic materials contemplated herein include, but are not limited to, alumina, zirconia, silica, yittria, magnesia, and mixtures thereof. The present invention is applicable for the removal of ceramic material and casting cores with any density. It is understood herein that at least one form of the present invention contemplates the removal of the ceramic casting material and/or ceramic casting cores from the cast component without any substantial deterioration and/or attack to the casting.

Figure 4:
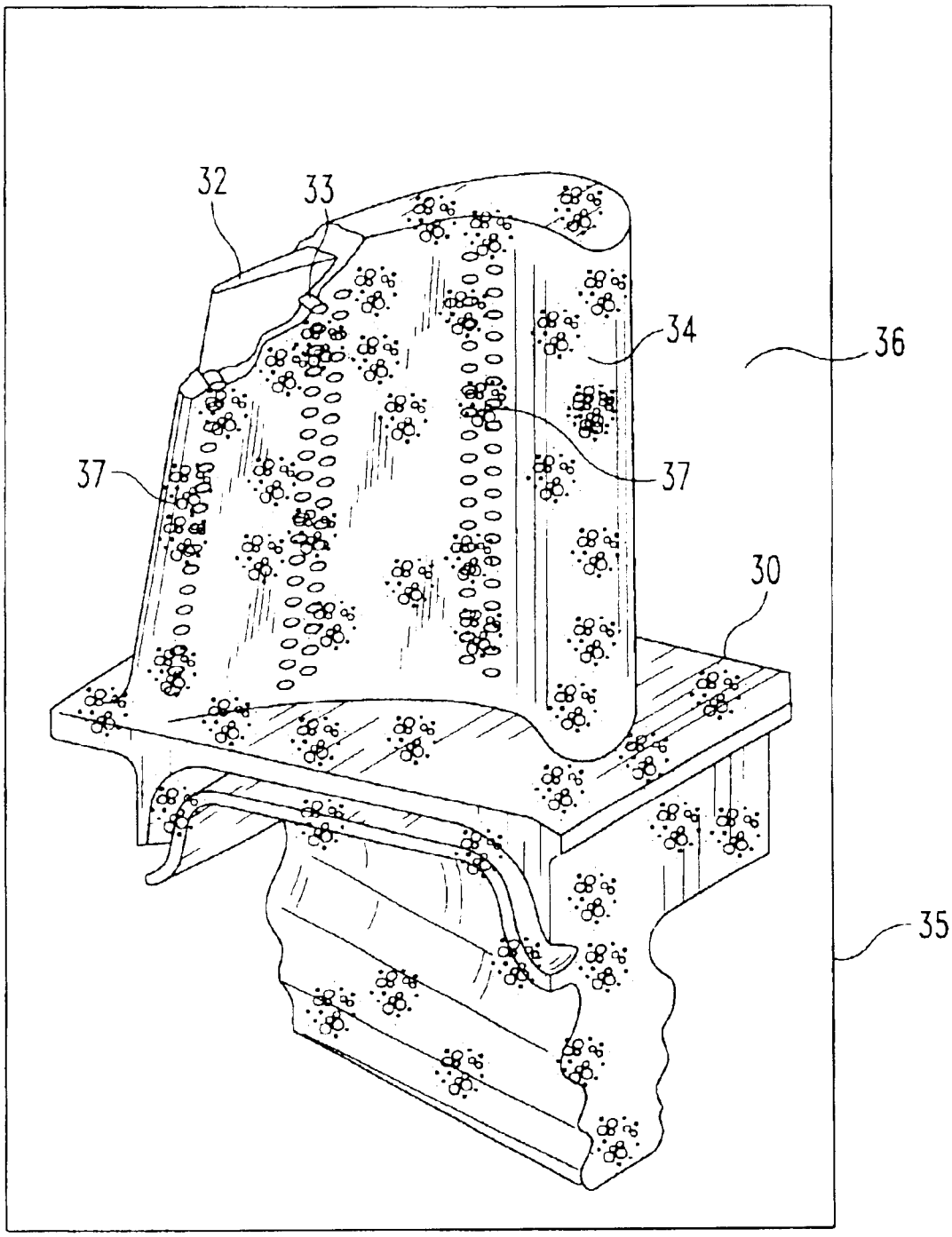
FIG. 4 is an illustrative view of the component of FIG. 3 subjected to one method of the present invention.
Figure 4A:
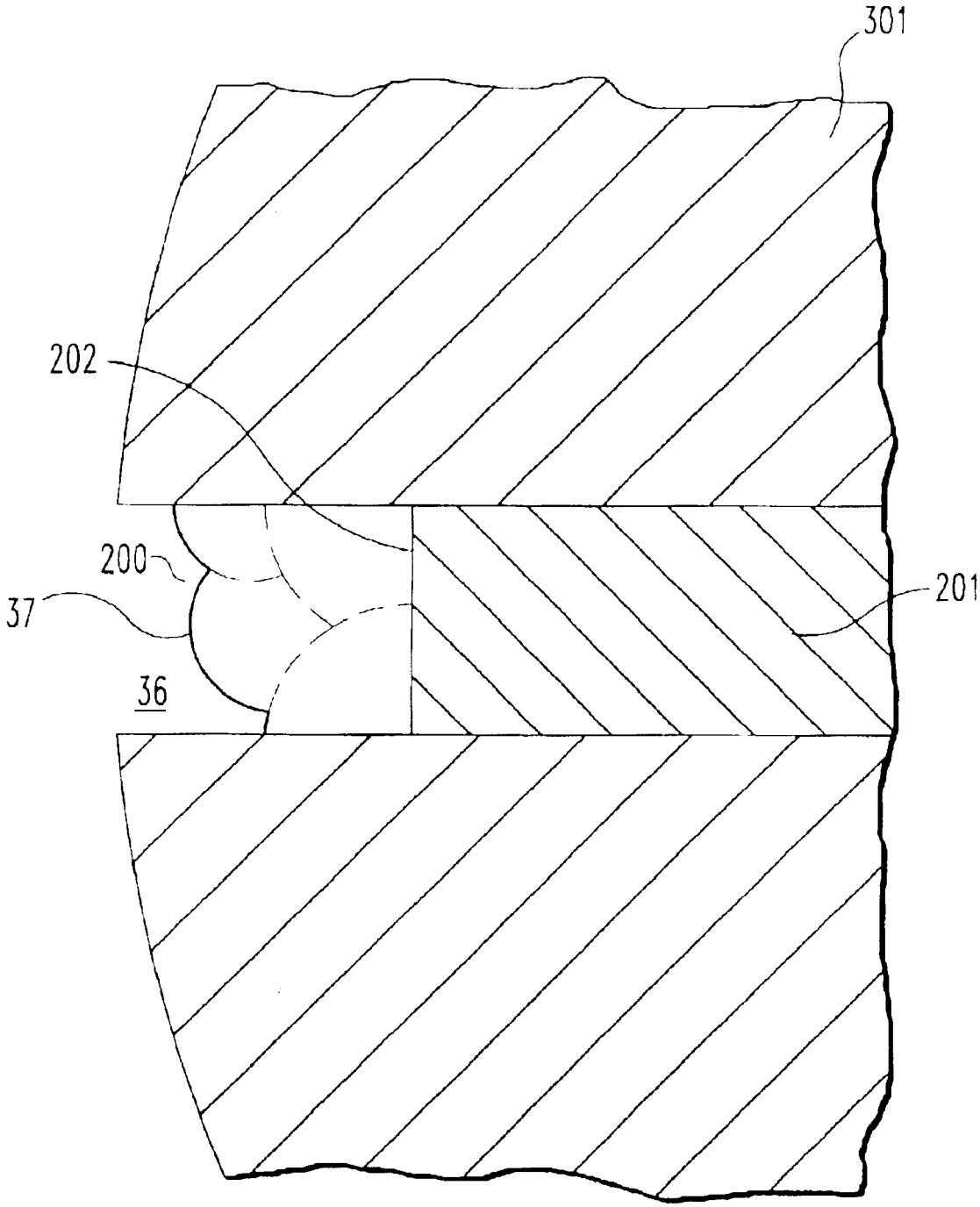
FIG. 4A is an illustrative view of bubble nucleation on surfaces defining an internal passageway within the component.

With reference to FIGS. 4 and 4A, there is illustrated the cast component 30 disposed within a closed vessel 35. The illustrative view in FIGS. 4 and 4A is of a transient phase where the leaching material 36 is superheated and causes the nucleation of boiling bubbles from surfaces of the component 30 and surfaces of the ceramic material. However, it should be understood that this is not a steady state phenomenon and is only a transient state in the process and there are other phases in the process where the nucleation of boiling bubbles is not present on the surfaces of the component 30 and the cores.

The closed vessel 35 contains a sufficient quantity of leaching material 36 to fill the vessel 35 to a suitable level, the closed vessel 35 forming all or a portion of a closed system. The leaching material 36 is preferably in a fluid phase while the removing of the ceramic material and/or ceramic casting cores 32 and 33 from the cast component 30 is occurring. More preferably, the leaching material is in a liquid phase during the ceramic material and/or ceramic casting core removal process. However, the present invention contemplates a phase change for at least a portion of the leaching material during portions of the present invention. One form of the present invention contemplates that the leaching material is one or more aqueous alkali hydroxides. Preferably the leaching material has the formula MOH, where M is selected from the group consisting of lithium, sodium, potassium, rubidium and cesium. More preferably, the leaching material is KOH or NaOH. In one embodiment of the present invention the leaching material is about 82.3 wt % KOH and the balance is water. However, the present invention contemplates other concentrations and types of leaching materials including, but not limited to, alkaline, acidic or solvents.

With reference to FIGS. 4 and 4A, there is illustrated the processing of the cast component 30 with ceramic cores 32 and 33 in a leaching material 36. It is understood that the illustrations in FIGS. 4 and 4A, provide a view of a transient condition during the process wherein the superheated leaching material 36 is causing nucleation of boiling bubbles all over the internal and external surfaces of the component and ceramic material that are disposed in contact with the leaching material. In this phase the leaching material 36 is superheated and bubbles 37 are forming along the inner and outer surfaces of the cast component 30 and on the cores 32 and 33 that are in fluid communication with the leaching material. The boiling bubbles are formed on and along the surfaces of the cast component and surfaces of the cores including defining the regions adjacent the core-leaching interface. The plurality of boiling bubbles 37 creates areas of local agitation and fluid movement to displace the leaching material at the bubble nucleation site and refill the area with other leaching material. It is recognized that during the ceramic core removal process there is often leaching material that is at least partially depleted in comparison with the bulk leaching material in the vessel. This partially depleted leaching material is often present at the core-leaching interface. The presence of this at least partially depleted leaching material at the core-leaching interface slows the process of removing the ceramic cores and/or ceramic material from the cast component 30. The boiling bubbles function to drive the at least partially depleted leaching material from the core-leaching interface and facilitate replacement with other leaching material.

With reference to FIG. 4A, there is schematically illustrated the nucleation of bubbles 37 from surfaces within an internal passageway 200 of the component 30. The component 30 includes ceramic material 201 that is in contact with the leaching material 36 at the leaching interface 202. In the superheated phase there is the transient nucleation of the boiling bubbles 37 that sweep the leaching material 36 away from the leaching interface 202. Upon the boiling bubbles dissipating, other leaching material flows into the void left by the boiling bubbles dissipation and contacts the ceramic material at the leaching interface, thereby replenishing the region surrounding the leaching interface 202 with leaching material.

Figure 5:
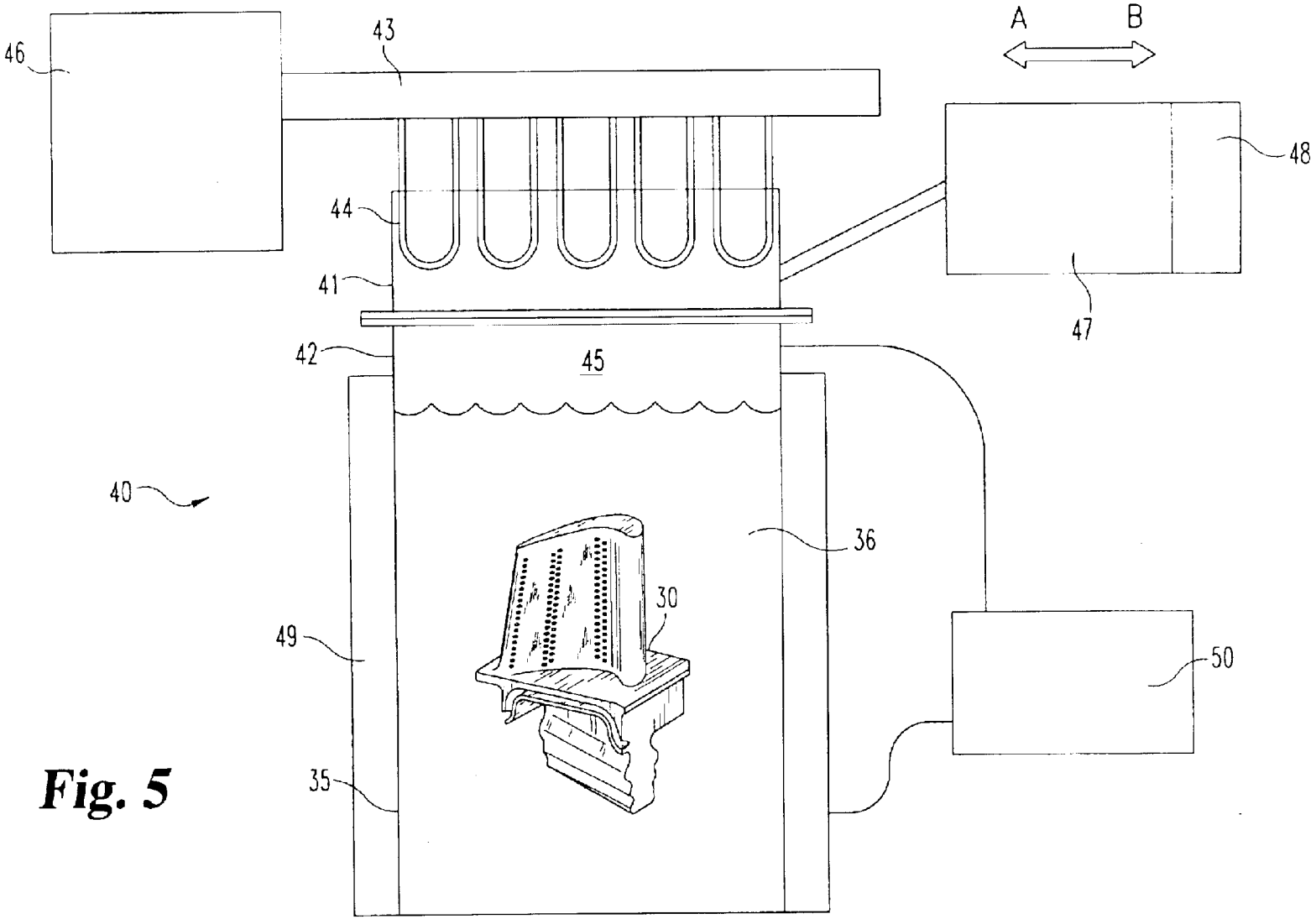
FIG. 5 schematically illustrates a system comprising one embodiment of the present invention.

With reference to FIG. 5, there is schematically illustrated a ceramic material leaching system 40 for removing ceramic material and/or ceramic cores from the cast component 30. In one form the ceramic material leaching system 40 includes a vessel 35. The vessel 35 includes a removable lid 41 that creates a fluid tight seal with the vessel container 42. The cast component 30 and leaching material 36 can be loaded through the opening provided when the lid 41 is removed. A heat exchange system 43 includes at least one cooling route 44 disposed with the vessel 35 to cool and condense vapors in the headspace 45. The heat exchange system includes a coolant supply 46 that circulates a quantity of coolant through the cooling route 44 to cause the condensation of vapors located within the headspace 45. In one form of the ceramic material leaching system 40 the heat exchange system is a condenser having a plurality of cooling routes disposed within the headspace 45 of the vessel 35. In one embodiment of the system 40 the cooling media flowing through the cooling routes 44 is water having a nominal temperature of about 80° F. However, the present invention contemplates other types of cooling media, cooling media temperatures and condenser systems as would be known to those skilled in the art.

A volume variation mechanism 47 is disposed in fluid communication with the vessel 35. In the ceramic material leaching system 40 the volume variation mechanism 47 includes a piston 48 that is moveable to change the volume of the closed system 40. The closed system includes the vessel 35, the volume variation mechanism 47 and any interconnecting fluid flow passageway(s). Upon the vessel 35 being placed in a closed condition, the ceramic material leaching system 40 defines a totally closed system with an interior volume that does not allow for the entry or exit of material from within the interior volume during the processing of the cast component 30. More specifically, the atoms in the interior volume remain fixed in quantity during the processing of the cast component 30 when the system is in a closed state. Piston 48 is moved and the volume within the system is changed with a resulting change in pressure but with no substantial change in the quantity of atoms within the interior volume of the closed system. This closed system inhibits a change in the concentration of the leaching material by evaporation from the vessel. As should be appreciated the gas pressure in the headspace 45 is changed by the movement of piston 48. The piston 48 has a hermetic seal that prevents the passage of material from the closed system 40. A heater 49 is included as part of the ceramic material leaching system 40. In one form of the present invention the heater 49 is a strap resistant heater that provides the required energy to the vessel 35. However, the present invention contemplates a variety of heaters including, but not limited to, molten metal bath heaters, resistant heaters, radiant quartz heaters, and induction heaters. The present invention contemplates a heater having the capacity to heat the vessel 35, leaching material 36 and cast component 30 to predetermined temperatures in specified times.

The vessel 35 and other components within the ceramic material leaching system 40 are formed of materials selected to withstand degradation from the leaching material 36. In a preferred form of the present invention the vessel 35 and system components in fluid communication with the leaching material 36 are nickel-based materials. In one form of the present invention, the vessel 35 is about eighteen inches in diameter and twenty inches deep and is formed of nickel. While the figures herein illustrates the processing of one cast component at a time it is understood that a plurality of parts can be placed within the vessel 35 to facilitate bulk processing. Whether the parts can be stacked on top of the other or require the use of racks in the vessel 35 will be determined based upon the geometry and properties of the individual cast components.

A control device 50 is in operational communication with sensors connected to the ceramic material leaching system 40. In one form of the present invention the temperature of the leaching material 36 is monitored by thermocouples. The temperature readings are utilized in the control scheme to indicate when the piston 48 should be moved to change the pressure with the system 40. The present invention contemplates monitoring a variety of parameters associated with the leaching material including, but not limited to, temperature, pressure, acoustic, humidity, opacity. Further, the present application contemplates the use of a variety of sensors including theromcouples, transducers, acoustic sensors, fiber optics, etc.

Figure 6:
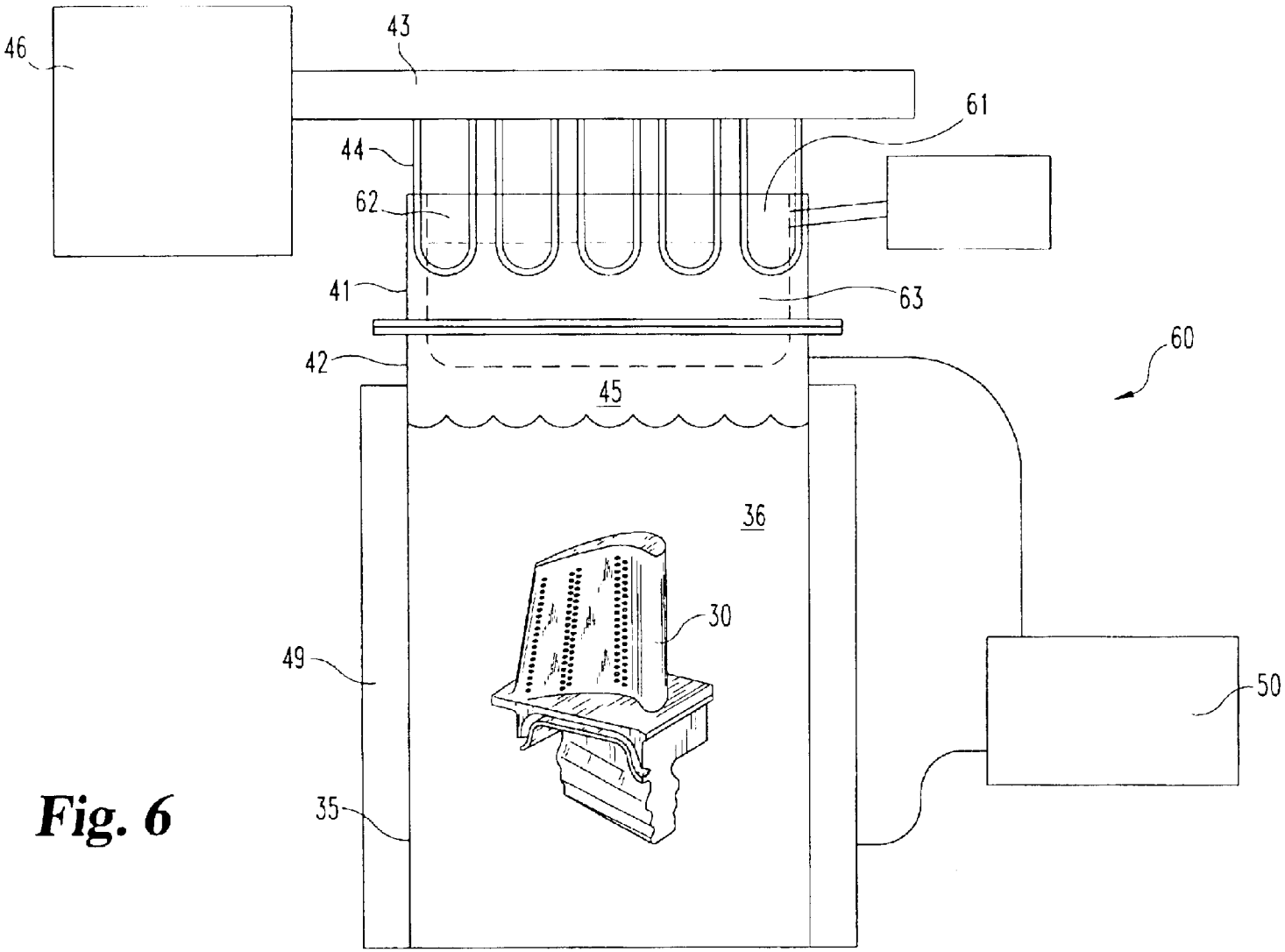
FIG. 6 schematically illustrates a system comprising another embodiment of the present invention.
Figure 7:
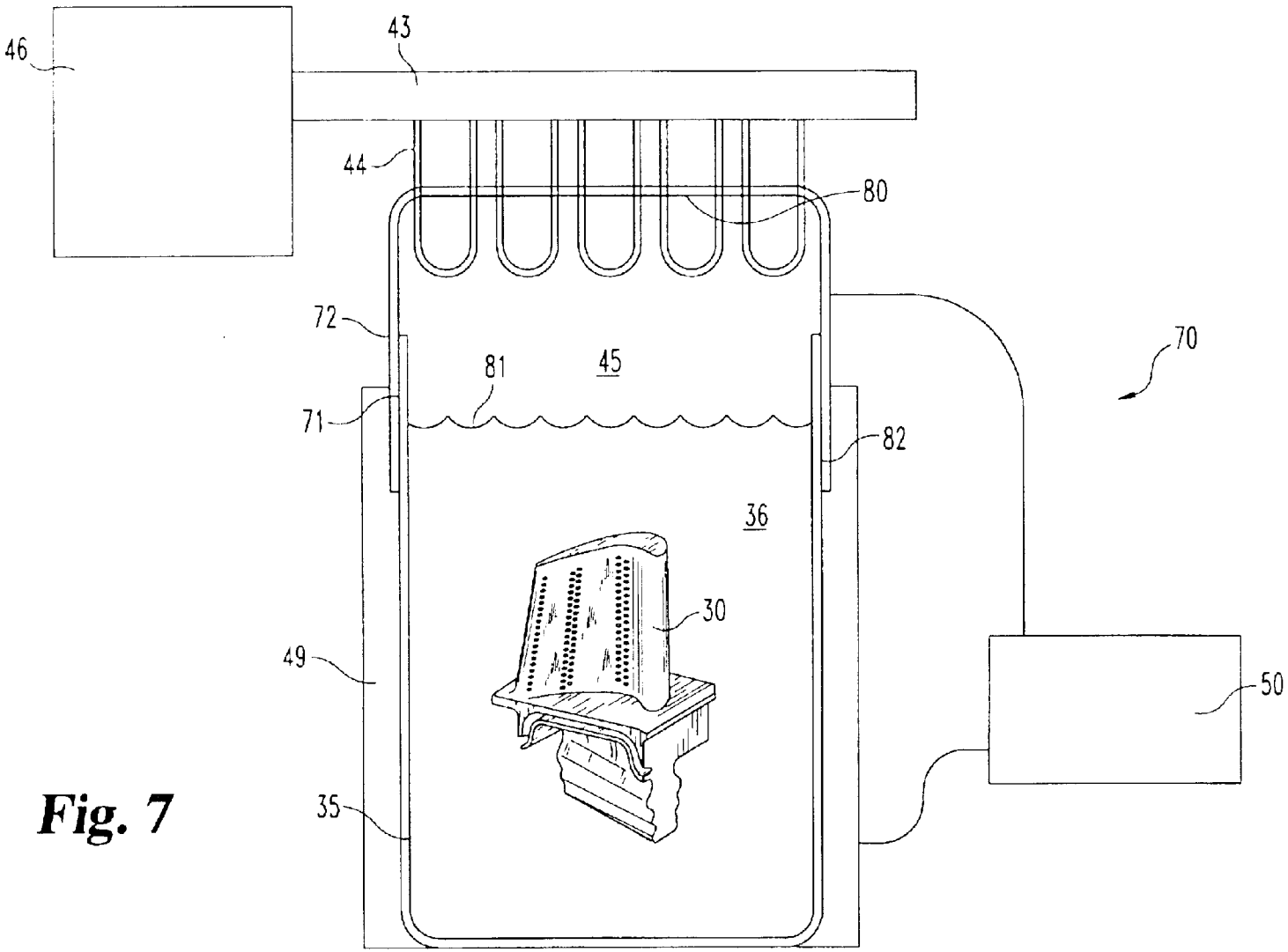
FIG. 7 schematically illustrates a system comprising another embodiment of the present invention.

With reference to FIGS. 6 & 7, there is illustrated alternative ceramic material leaching systems of the present invention. The ceramic material leaching system of FIG. 6 is labeled 60 and the ceramic material leaching system of FIG. 7 is labeled 70. The systems 60 and 70 are substantially similar to the ceramic material leaching system 40 with the major exception being the volume variation mechanism. The reader should appreciate that like feature numbers will indicate like features with the prior described ceramic material leaching system 40. Referring to FIG. 6, there is schematically illustrated one form of the ceramic material leaching system 60. The volume variation mechanism 61 includes a bladder disposed within the vessel 35 and extendable into the headspace 45 to change the volume that gaseous materials can occupy. The volume variation mechanism 61 includes an extendable bladder 62 that can be expanded from a first state to the enlarged state indicated by feature number 63. Expansion and contraction of the bladder 62 changes the volume available for the gas in the headspace 45 without changing the number of atoms in the interior volume.

Referring to FIG. 7, there is illustrated one form of ceramic material leaching system 70. The volume variation mechanism 71 includes the ability to change the volume available for gas in the headspace 45 by moving the location of the upper cap surface 80 relative to the leaching material surface 81. The lid 72 is disposed in a sliding sealing fit with the outer surface 82 of the vessel 35. Upon wishing to decrease the volume available for gas within the headspace 45 the upper cap surface 80 is brought closer to the leaching material surface 81 by sliding the lid 72 along the outer surface 82 of vessel 35. In order to increase the volume available for gas within the headspace 45 the upper cap surface 80 is moved farther away from the leaching material surface 81 by sliding the lid 72 along the outer surface 82 of vessel 35. The ceramic material leaching system 70 allows for the change in volume within vessel 35 with a resulting change in pressure without changing the atoms within the system. The present invention contemplates other means to change the pressure within the closed volume without changing the atoms within the system.

Figure 7A:
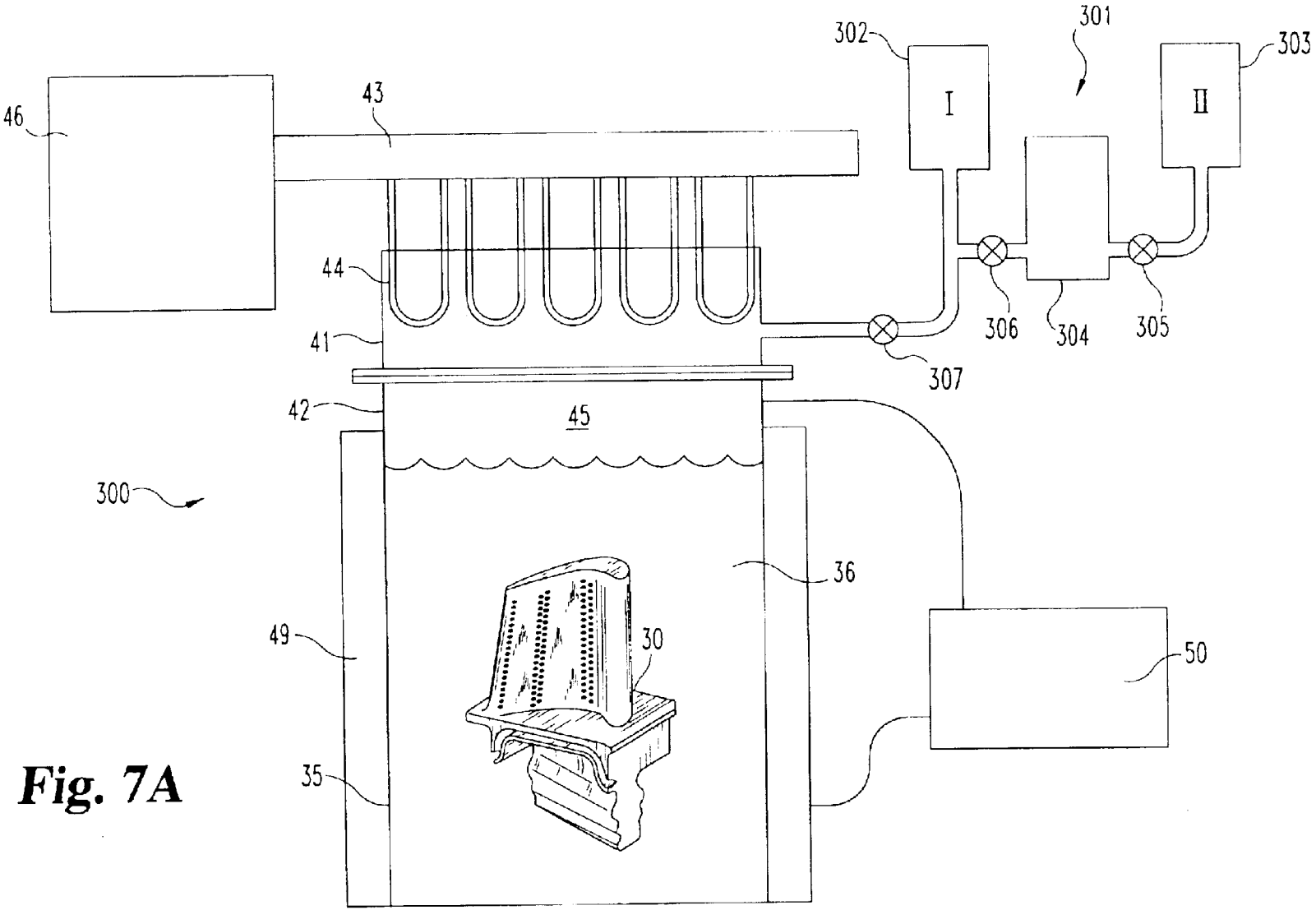
FIG. 7A schematically illustrates a system comprising another embodiment of the present invention.

With reference to FIG. 7A, there is schematically illustrated another form of the ceramic material leaching system 300. The ceramic material leaching system 300 includes a pressure variation mechanism 301 for varying the pressure that the leaching material 36 is exposed to. The pressure variation mechanism 301 includes a pair of vessels 302 and 303 adapted to contain fluid therein. The pressure variation mechanism 301 forms a portion of the closed system 300. A pump 304 is disposed in fluid communication with each of the vessels 302 and 303 and a series of valves 305, 306 and 307 are provided to selectively change the fluid flow passageways.

The system 300 is similar to the ceramic material leaching system 40 with the major exception being the replacement of the volume variation mechanism with the pressure variation mechanism 301. In one form of operation, the entire closed system is brought to a pressure equilibrium with all of the valves 305, 306 and 307 in an open state. Valve 307 is closed and valves 305 and 306 are opened and the pump 304 is run in order to reduce the pressure in vessel 302. When the ceramic material leaching system 300 needs to reduce the pressure that the leaching material is exposed to, the valve 306 is closed and valve 307 is opened to cause a reduction in pressure on the leaching material. During operation when it is desired to increase the pressure that the leaching material is exposed to, the valves 305, 306 and 307 are opened and the leaching material is exposed to the pressure associated within the pressure variation mechanism.

The operation of the ceramic material leaching system 40 will be further described with reference to FIGS. 5 and 8. The cast component 30 is located within the interior of vessel 35 and a portion of the ceramic material is in contact with the leaching material 36. In one form of the present invention, the component 30 is immersed in the leaching material. The leaching material 36 has an initial temperature and concentration. The heater 49 is energized to raise the temperature of the leaching material 36 and component 30 within the vessel 35. In one form of the present invention, the initial heating of the leaching material 36 within the vessel occurs while open to the atmosphere and is continued to about an initial boil condition. At about the point of initial boil, the lid 41 is placed on the vessel 35 and secured to provide a fluid-tight seal and isolate the interior of the system from that external to the system. In another form of the present invention, the lid 41 is placed on the vessel 35 and secured to provide a fluid-tight seal and isolate the interior of the system from that external to the system before heating the vessel. It should be understood that the closed system in FIG. 5 includes the volume variation mechanism 47. The leaching material is than heated to about the point of initial boil. Further, the present invention always operates with the system closed during the processing cycles utilized to remove the ceramic material from the component, regardless of whether the vessel was open or closed during the initial heating phase. During the processing of the cast component 30 at least one parameter of the leaching material 36 is monitored. More particularly, in one form of the present invention the temperature and/or rate of change of the temperature of the leaching material is being monitored throughout the core removal process.

Figure 8:
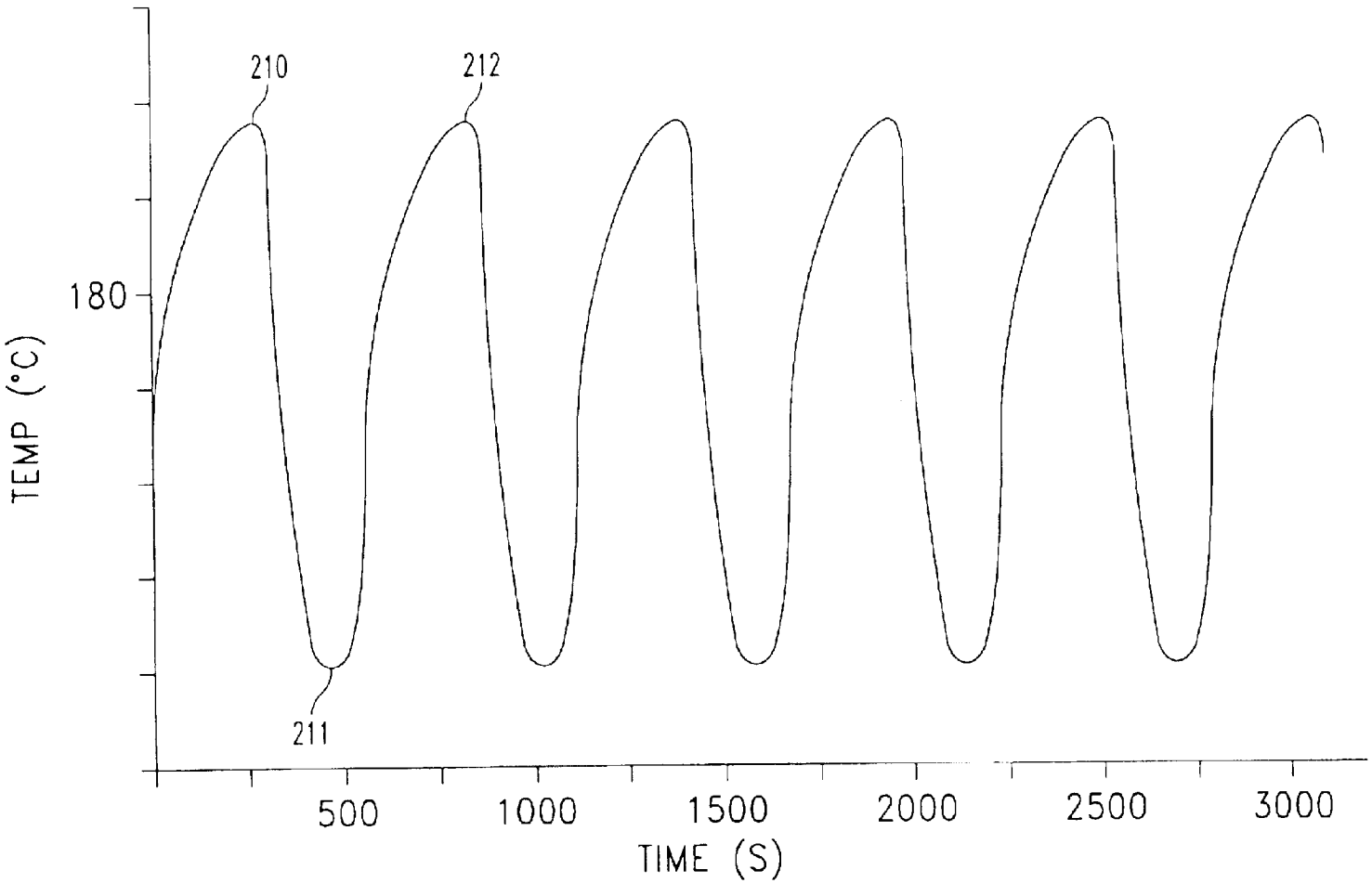
FIG. 8 illustrates a graphical representation of one embodiment of the leaching cycle of the present invention.

With reference to FIG. 8, there is illustrated a plot of the temperature of the leaching material 36 versus the time that the process has been running. The cast component 30 is immersed in the leaching material 36 and the heater 49 is actuated to heat the vessel 35. The leaching material 36 is heated from an initial condition to a boiling point within the vessel 35 that is marked as feature number 210 on FIG. 8. The vessel 35 remains closed during the rest of the process and in one embodiment was closed during the initial heating of the leaching material. At a predetermined point, about the initial boiling point, the pressure is reduced within the vessel 35 to cause the leaching material 36 to become superheated. The lower-pressure portion of the process defines the reduction in pressure and resulting superheating of the leaching material. In one form of the invention, the pressure is reduced by increasing the volume without having a change in the atoms within the system. As the superheated leaching material 36 boils within the vessel 35 the leaching material 36 has a transient phase where there is nucleation of boiling bubbles on all of the surfaces that the leaching material contacts. The boiling of the superheated leaching material 36 functions to reduce the superheat of the leaching material and produce vapor in the headspace 45 of the vessel 35. The present invention contemplates a variety of leaching materials, concentrations, and operating pressures that will affect boiling temperatures. The plot in FIG. 8 is illustrative of only one leaching material under one set of conditions. It should be understood that other temperature profiles are contemplated herein. More specifically, the present invention contemplates a wide variety of boiling points and temperature rates of change depending upon parameters such as material, concentrations, and pressure.

In one form of the present invention, the temperature of the leaching material 36 and the associated rate of change of this temperature is monitored and as the leaching material approaches thermodynamic equilibrium the rate of change of the temperature decreases. When the rate of change of the temperature of the leaching material is equal to a predetermined value, the pressure within the vessel 35 is increased. In one form of the present invention, the pressure within the vessel 35 is increased by decreasing the volume without a change in the atoms within the system. Referring to FIG. 8, the point where the change in pressure results is labeled 211. The portion of the process associated with the higher-pressure condition and corresponding temperature increase of the leaching material will be referred to as the higher-pressure portion of the process. This portion of the process is shown on the plot in FIG. 8 between point 211 and point 212. This increase in pressure within the vessel raises the boiling temperature of the leaching material 36. In one embodiment of the present invention the increase in pressure also functions to stop the boiling of the leaching material. During this higher-pressure portion of the process, the superheat within the leaching material is replenished.

The vessel 35 now has the leaching material being heated at the increased pressure. The leaching material 36 absorbs energy from the heater 49 and the temperature of the leaching material 36 increases. The temperature of the leaching material 36 and the associated rate of change of the leaching material is monitored and when the rate of change of the temperature of the leaching fluid is equal to a predetermined value the pressure within the vessel 35 is reduced. The reduction in pressure within the vessel 35 causes the leaching material 36 to become superheated as discussed above and the cycle continues. In summary the ceramic material leaching system will cycle between the lower-pressure portion of the process and the higher-pressure portion of the process until the ceramic material has been removed from the cast component or the process is terminated for another reason. While the system represented in FIG. 8 shows a lower-pressure portion followed by a higher-pressure portion, the present invention also contemplates that the cycle could be a higher-pressure portion followed by a lower-pressure portion.

The processing of the cast component will cycle through the above process portions to remove the ceramic material from the casting. In one form of the present invention, a predetermined overall macro process time is empirically determined based upon the cast component and the ceramic material and/or ceramic casting cores within the material. Thus, the whole process will continue switching between the lower-pressure portion and the higher-pressure portion until the predetermined overall processing time has expired. In another form of the present invention, parameters associated with the leaching material will be monitored and the process will be terminated when the parameter meets a condition representative of the completion of the ceramic material removal. It is understood that the term removal as used herein shall be broadly construed and includes, only provided to the contrary, both a complete or partial removal of material.

In one form of the present invention the cycling between the lower-pressure portion and the higher-pressure portion of the process continues while the leaching material concentration within the vessel 35 is monitored and/or tested continuously or at intervals. The leaching material is depleted during the process of removing the ceramic material from the cast component. This depletion of the leaching material affects the speed of removal of the ceramic material and causes a boiling point change. One form of the present invention tests the leaching material and compares a time/temperature plot of the leaching material to a benchmark plot of time and temperature (like FIG. 8) for a known concentration of leaching material. Upon comparison of the test data with the benchmark plot, the difference due to depletion of the leaching material will show up as an offset in the curve, such as a change in peak temperature and/or average temperature. When the offset in the curve is equal to a predetermined condition, the system will signal that the leaching material should be changed.

As discussed previously, the present invention contemplates that the desired change in pressure within the vessel 35 is accomplished by a resulting change in volume within the system with no substantial change in the atoms within the closed volume. With reference to FIGS. 5–7, there is described various volume variation mechanisms that are controlled to change the volume of the system. The reader should appreciate that the change in volume will change the pressure on the gas in the headspace 45 of the ceramic material leaching systems of the present invention without any change in atoms within the closed volume.

Figure 9:
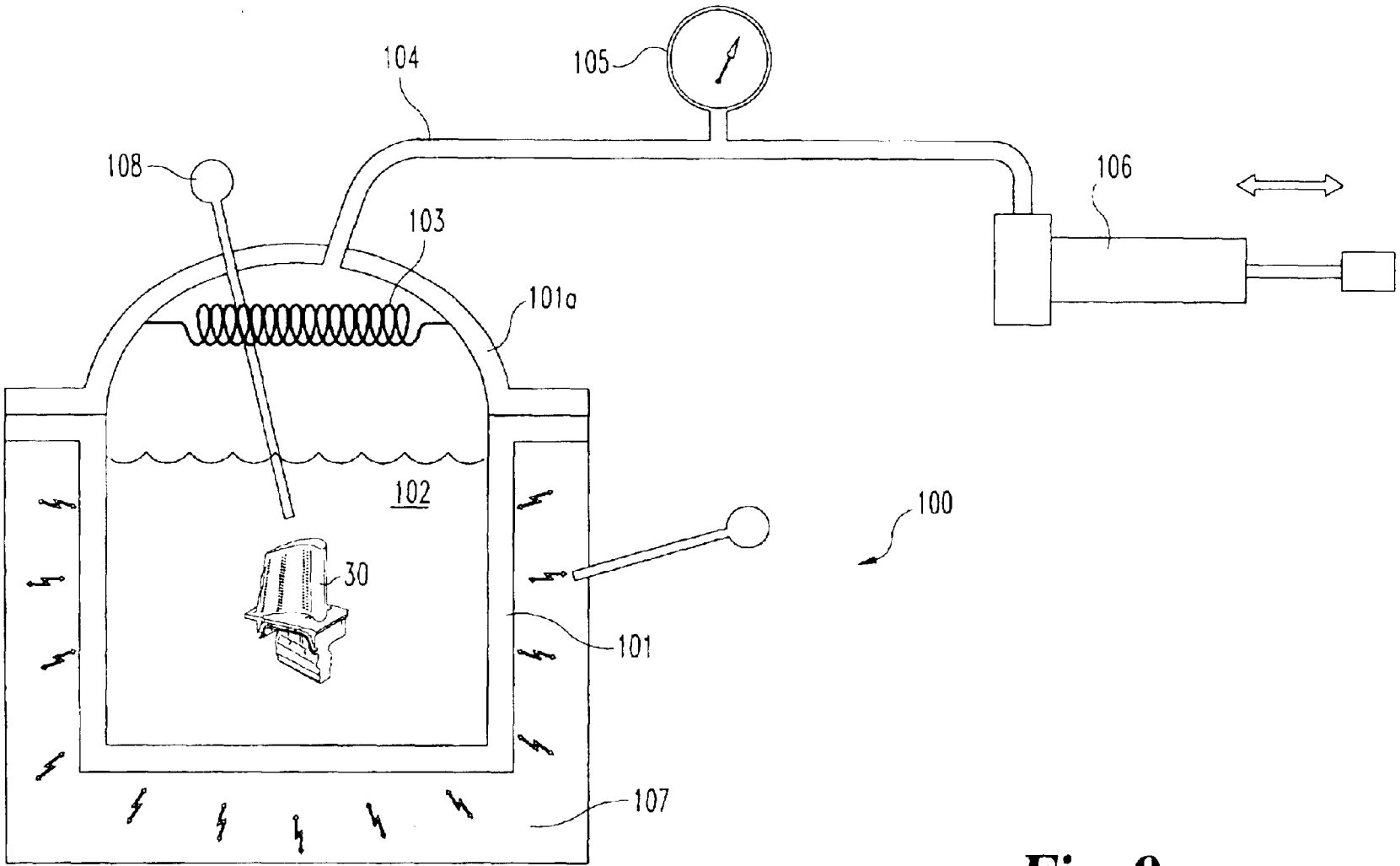
FIG. 9 illustrates a schematic of another embodiment of the present invention.

With reference to FIG. 9, there is illustrated a closed leaching system 100 according to another form of the present invention. The closed leaching system 100 includes a heated, sealed leaching tank 101 filled with leaching fluid 102. Included in the top 101*a* of the leaching tank 101 is a condenser 103. A gas line 104 connects the tank 101 to a pressure transducer 105, and a device 106 for precisely adjusting the volume of the system, such as a piston and cylinder or a bladder. Because this is a truly closed system, the cumulative volume of the leaching tank, the pressure line, and the cylinder is referred to as the leaching vessel.

The leaching tank 101 is preferably heated by high-capacity heat source 107 such as a melted solder bath to provide a relatively constant source of heat. Other heat sources may be utilized to heat the leaching fluid, such as a radiant quartz heater or induction heater. A condenser 103 is fitted inside the leaching tank 101 to condense leaching fluid vapor during the leaching cycle.

A temperature transducer 108 measures the temperature of the leaching fluid 102. The volume adjustment device 106 is preferably a cylinder or piston, which can be precisely driven by electronically controlled linear actuator.

An electronic controller is connected to the cylinder, and the temperature and pressure transducers 108 and 105 respectively. The controller is configured to measure and change the position of the cylinder according to inputs received from the transducers.

The leaching system 100 according to one form of the present invention maintains the quantity of each of its constituents or ingredients at constant levels, including water and leachant, whether the leachant is KOH, NaOH, or other known composition.

In one form of the present invention, the system 100 is operated by placing the object 30 to be leached inside the leaching fluid 102 and sealing the leaching tank 101. The solder bath 107 is brought up to a temperature above the boiling temperature of the leaching fluid, the boiling temperature varies depending on the pressure and concentration of the leaching fluid of choice. With the leaching tank 101 sealed, the leaching fluid 102 is increased to its boiling temperature, at which time the controller is programmed to actuate the cylinder to increase the volume of the leaching tank 101. The increased volume decreases the leaching fluid pressure, causing the leaching fluid 102 to become superheated. Being superheated, boiling occurs throughout the leaching fluid 102 at all surfaces it contacts, including surfaces inside the object 30. The leaching fluid 102 boils to reduce the superheat. As the fluid approaches thermodynamic equilibrium at the reduced pressure, the rate of change of temperature of the leaching fluid 102 decreases. The boiling produces vapor which is condensed back into the leaching fluid 102 at a cooler temperature, thereby speeding the release of heat from the leaching fluid 102.

As seen in FIG. 8, the temperature of the leaching fluid 102 decreases during boiling as it moves toward a state of equilibrium associated with the given pressure, and concentration of leaching fluid 102. The control system is programmed to monitor the rate of change of temperature of the leaching fluid 102 after its pressure is decreased. When the temperature change reaches a predetermined rate, the control system repressurizes the leaching tank 101 by actuating the cylinder to decrease the volume inside the leaching tank 101. The corresponding pressure increase raises the boiling temperature of the fluid and stops the boiling of the leaching fluid 102. The fluid rapidly absorbs heat from the solder bath 107, and the temperature increases. Once the rate of change of temperature reaches a predetermined level, the controller initiates another boiling cycle by increasing the leaching tank 101 volume and lowering its pressure. This cycle is repeated until ceramic material has been completely leached from the metallic part 30.

The leaching system 100 can be optimized by varying the chemistry, the temperature, and the pressure of the leaching fluid. Increasing the leaching fluid temperature from 220 degrees C. to 250 degrees C. results in a measurable increase in the amount of material leached from the samples of A1203 over a given time. In order to expose objects to the most efficient leaching activity, it is possible to use the control system to optimize the boiling cycles by initiating cycles based on the time rate of change of the leaching fluid temperature. Further examples of the leaching system 100 are set forth below:

1. A process for removing ceramic material from a metallic object comprises:
   a. immersing the object in leaching fluid and isolating the environment inside the vessel from atmospheric environment;
   b. increasing the temperature of the leaching fluid to its boiling temperature or a temperature at which boiling will occur as a result of a subsequent pressure drop;
   c. using the piston to increase the volume of the leaching vessel to lower the pressure and boiling point of the fluid, thereby initiating boiling of the fluid;
   d. monitoring the rate of decrease in temperature of the fluid;
   e. decreasing the volume of the leaching vessel when the rate of change in temperature of the leaching fluid reaches a predetermined level;
   f. adding heat to the leaching fluid until the rate of change of its temperature reaches a minimum heating level;
   g. repeating steps c through f until ceramic material has been completely leached.
2. The process of example 1 wherein steps b through f are accomplished by an electronic controller.
3. The process of example 1 wherein a temperature sensor is used to measure the temperature of the fluid.
4. The process of example 2 wherein the controller uses the pressure sensor to initiate the cycle.
5. The process of example 2 wherein the controller uses time intervals to trigger the cycle.
6. The process of example 1 where the leaching temperature is greater than 220 degrees C.
7. The process of example 1 wherein the temperature of the fluid is raised to approximately 250 degrees C.
8. The process of example 1 wherein the concentration of KOH is varied to alter the boiling temperature.
9. The process of example 1 wherein the volume of each ingredient in the vessel remains constant.
10. An apparatus for leaching material from a molded metallic object, comprising:
    a closed vessel containing a leachant;
    a heat supply for heating the leachant inside the vessel;
    a condenser coupled to the vessel for condensing vapor from the vessel;
    a temperature transducer for measuring temperature of the leachant;
    a pressure transducer for measuring pressure within the vessel;
    means for precisely changing the volume of the vessel;
    an electronic controller for operating the volume changing means according to time;
    and feedback from the pressure and temperature transducers.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow. In reading the claims it is intended that when words such as "a," "an," "at least one," "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary.

What is claimed:

1. A method for removing a ceramic material from a cast component, comprising:
(a) placing the cast component within a vessel with at least a portion of the ceramic core in contact with a leaching material;
(b) heating the leaching material;
(c) reducing the pressure within the vessel to superheat the leaching material and nucleate boiling bubbles on at least the cast component;
(d) increasing the pressure within the vessel to raise the boiling temperature of the leaching material; and
(e) wherein during at least (c) and (d) the vessel is closed to inhibit a change in the concentration of the leaching material by evaporation from the vessel.

2. The method of claim 1, wherein said reducing and said increasing occur at about respective thermodynamic equilibrium points within the leaching material.

3. The method of claim 1, which further comprises repeating acts (c) through (e) to remove the ceramic material from the cast component.

4. The method of claim 3, wherein said repeating occurs until the ceramic material is about completely removed from the cast component.

5. The method of claim 3, which further comprises sensing a first parameter of the leaching material, and if said sensed first parameter is equal to a first predetermined condition said reducing is triggered, and if said sensed first parameter is equal to a second predetermined condition said increasing is triggered, wherein during said sensing the vessel is closed to inhibit a change in concentration of the leaching material by evaporation from the vessel, and wherein said repeating includes the act of said sensing.

6. The method of claim 5, wherein said first parameter is one of a temperature and a rate of change of the temperature.

7. The method of claim 6, wherein said first parameter is defined by the rate of change of the temperature of the leaching material.

8. The method of claim 3, wherein said reducing results in vaporizing a portion of the leaching material into vapor, and which further includes condensing the vapor, wherein during said condensing the vessel is closed to inhibit a change in the concentration of the leaching material by evaporation from the vessel, and further wherein said repeating includes repeating the act of condensing.

9. The method of claim 1, wherein said reducing utilizes increasing the volume within the closed vessel without changing the number of atoms within the vessel and said increasing utilizes decreasing the volume within the closed vessel without changing the number of atoms within the vessel.

10. The method of claim 9, which further includes providing a volume variation mechanism, and wherein the volume variation mechanism defining a portion of the closed vessel, and wherein said volume variation mechanism is actuated during said reducing to increase the volume and during said increasing to decrease the volume.

11. The method of claim 1:

which further comprises sensing a first parameter of the leaching material, and if said sensed first parameter is equal to a first predetermined condition said reducing is triggered, and if said sensed first parameter is equal to a second predetermined condition said increasing is triggered;

wherein said reducing results in vaporizing a portion of the leaching material into vapor, said reducing utilizes increasing the volume within the closed vessel without changing the number of atoms within the vessel and said increasing utilizes decreasing the volume within the closed vessel without changing the number of atoms within the vessel;

which further comprises condensing the vapor;

wherein in act (e) the vessel is also closed to inhibit a change in the concentration of the leaching material by evaporation from the vessel during said sensing and said condensing; and which further comprises repeating said acts (c) through (e) and said acts of sensing and condensing.

12. The method of claim 11, wherein the leaching material has the formula MOH, wherein M is selected from the group consisting of lithium, sodium, potassium, rubidium and cesium.

13. The method of claim 11, which further includes providing a volume variation mechanism, and wherein the volume variation mechanism defining a portion of the closed volume within the vessel, and wherein said volume variation mechanism is actuated during said reducing to increase the volume and during said increasing to decrease the volume.

14. The method of claim 13, wherein the leaching material is KOH.

15. The method of claim 13, wherein the leaching material is NaOH.

16. The method of claim 13, wherein the leaching material is a mixture of KOH and NaOH.

17. The method of claim 1, wherein said increasing follows said reducing and substantially stops the nucleation of boiling bubbles.

18. The method of claim 1, wherein in said reducing to superheat the leaching material and nucleate boiling bubbles on at least the cast component causes the nucleation of boiling bubbles on the surfaces of the cast component and surfaces of the ceramic material disposed in contact with the leaching material.

19. The method of claim 18, wherein the nucleation of boiling bubbles causes a movement of the leaching material away from each of the boiling bubble nucleation sites on the surface of the cast component and the ceramic material and further comprising replenishing the leaching material at each of the boiling bubble nucleation sites.

20. The method of claim 1, which further includes testing the leaching material within the vessel to determine whether it satisfies a predetermined condition and if the leaching material does not satisfy a predetermined condition indicating that the leaching material should be changed.

21. The method of claim 20, wherein said testing includes running the leaching material a plurality of times through acts (c) through (e) and sensing and recording data associated with a first parameter of the leaching material.

22. A system using leaching material to remove material from an object, comprising:

a vessel adapted to contain a quantity of the leaching material, wherein said vessel defines a closed volume including a headspace for gaseous material;

a heater operable to heat the leaching material within said vessel;

a sensor for sensing a first parameter associated with the leaching material within the vessel; and a volume variation mechanism defining a portion of said closed volume, said volume variation mechanism operable to change the size of said headspace and pressure therein without changing the number of atoms within said closed volume, said volume variation mechanism being operable upon the first parameter satisfying a first predetermined condition.

23. The system of claim 22, wherein said volume variation mechanism is operable upon the first parameter satisfying a second predetermined condition, and wherein if said first predetermined condition is satisfied the size of the headspace is reduced and the pressure within the closed volume is increased, and further wherein if the second predetermined condition is satisfied the size of the headspace is increased and the pressure within the closed volume is decreased.

24. The system of claim 23, wherein when said second predetermined condition is satisfied and the headspace is increased the leaching material within the vessel is brought to a superheated state, and wherein in the superheated state the leaching material boils and nucleates boiling bubbles from all surface of the object, wherein when said first predetermined condition is satisfied the headspace is decreased and the boiling point of the leaching material within the vessel is increased and the superheat of the leaching material is replenished.

25. The system of claim 24, wherein when the leaching material boils a vapor is added into the headspace, and which further comprises a condenser operatively coupled with the headspace within said vessel, said condenser functioning to condense at least a portion of the vapor.

26. The system of claim 22, which further includes a controller to receive the sensed first parameter from the sensor, and wherein the controller uses the sensed first parameter to cycle the volume variation mechanism between a first headspace size and a second headspace size, wherein said first headspace size causes an increase in the pressure within the headspace and wherein the second headspace size causes a decrease in the pressure within the headspace.

27. The system of claim 22, which further includes means for sensing the leaching material and determining whether to change the leaching material within the vessel.

28. The system of claim 22, wherein said sensor defines a sensor for sensing one of a temperature and a time rate of change of temperature for the leaching material.

29. An system for removing ceramic material from a molded metallic object, comprising:

a closed vessel having an interior volume containing a first portion for leaching material and a second portion for gaseous material;

a heat supply for heating the leaching material within said vessel;

a condenser coupled to the vessel for condensing vapor within said vessel;

a sensor for sensing a first parameter of the leaching material;

means for precisely changing the pressure within the closed vessel without changing the quantity of atoms within said interior volume; and an electronic controller for operating the means for precisely changing the pressure according to time and feedback from the sensor.

* * * * *